United States Patent [19]

Sloan et al.

[11] Patent Number: 4,691,407

[45] Date of Patent: Sep. 8, 1987

[54] LIQUID RECOVERY UNIT

[76] Inventors: Alex Sloan, 284 Gt Western Rd., Aberdeen, United Kingdom, AB1 6PJ; Lyall Rennie, Dunisla, 5 Lochburn Dr., Kintore; Aberdeenshire, United Kingdom, AB5 0UW

[21] Appl. No.: 762,067

[22] PCT Filed: Nov. 23, 1984

[86] PCT No.: PCT/GB84/00402

§ 371 Date: Jul. 22, 1985

§ 102(e) Date: Jul. 22, 1985

[87] PCT Pub. No.: WO85/02356

PCT Pub. Date: Jun. 6, 1985

[30] Foreign Application Priority Data

Nov. 23, 1983 [GB] United Kingdom ..... 8331234

[51] Int. Cl.[4] ..... A47L 5/38

[52] U.S. Cl. ..... 15/339; 15/353; 55/417; 55/432

[58] Field of Search ..... 15/353, 321, 339; 55/417, 432

[56] References Cited

U.S. PATENT DOCUMENTS

| | | | |
|---|---|---|---|
| 3,173,164 | 3/1965 | Congdon | 55/432 X |
| 3,286,444 | 11/1966 | Boswinkle et al. | 55/432 X |
| 3,774,260 | 11/1973 | Emus | 15/353 X |
| 4,080,104 | 3/1978 | Brown | 15/353 X |
| 4,194,262 | 3/1980 | Finley et al. | 15/353 X |
| 4,207,649 | 6/1980 | Bates | 15/353 X |
| 4,378,611 | 4/1983 | Ninehouser | 15/353 |

*Primary Examiner*—Chris K. Moore

*Attorney, Agent, or Firm*—Gerald J. Ferguson, Jr.; Michael P. Hoffman; Ronni S. Malamud

[57] ABSTRACT

Apparatus for recovering drilling mud and the like comprises a vacuum pump (12) applying vacuum to a vessel (10). A hose (14) and suction head (22) allow an operator to remove the mud into the vessel (10). When the vessel (10) is full, vacuum is cut off by ball valve (16). A pneumatic logic circuit (20) detects loss of vacuum and disables vacuum pump (12) for a predetermined time, allowing the contents of vessel (10) to be discharged via flap valve (18) (or by pumping—FIG. 3). Discharging is thus automatic, without operator intervention.

7 Claims, 4 Drawing Figures

LIQUID RECOVERY UNIT

The present invention relates to apparatus for recovering liquids such as drilling mud and the like.

It is particularly but not exclusively envisaged that the apparatus is used on offshore oil rigs.

Generally, during drilling for oil, the drill pipe is frequently split, to add another section or to shorten the length of the pipe.

When the drill pipe is split, drilling mud spills onto the drill floor. This mud makes the drill floor slippery and is therefore potentially dangerous. Furthermore, the drilling mud contains additives, some of which can cause pollution. The drilling mud is usually recycled, so if some of the spilt mud can be recovered some expense is saved.

It is an object of the present invention to obviate or mitigate the aforesaid problems and aid in the economy of the process.

The present invention accordingly provides apparatus for recovering liquids, comprising a vessel for containing liquid, a vacuum pump for creating a vacuum in said vessel, conduit means for sucking liquid into said vessel, a first valve means adapted to cause a loss of vacuum in said vessel when the liquid reaches a predetermined level, means adapted to discharge liquid from the vessel when vacuum is lost, switching means adapted to shut off the air supply to the pump when vacuum is lost, and control means for delaying the start-up of the vacuum pump for a preset period. Discharge from the vessel may be by gravity or by means of a discharge pump connected into the bottom vessel outlet.

Preferably, said conduit means for sucking liquid into said vessel comprises a flexible suction hose provided with a suction head.

Preferably also, said first valve means comprises a ball float valve.

Said second valve means may comprise a flap valve positioned at the base of the vessel, or a non-return valve positioned in the outlet line from the base of the vessel.

Preferably, said switching means comprises a pressure switch which is activated by loss of vacuum in the vessel.

Preferably said control means comprises a timer.

Embodiments of the present invention will now be described, by way of example only, with reference to the accompanying drawings, in which.

Figure 1:
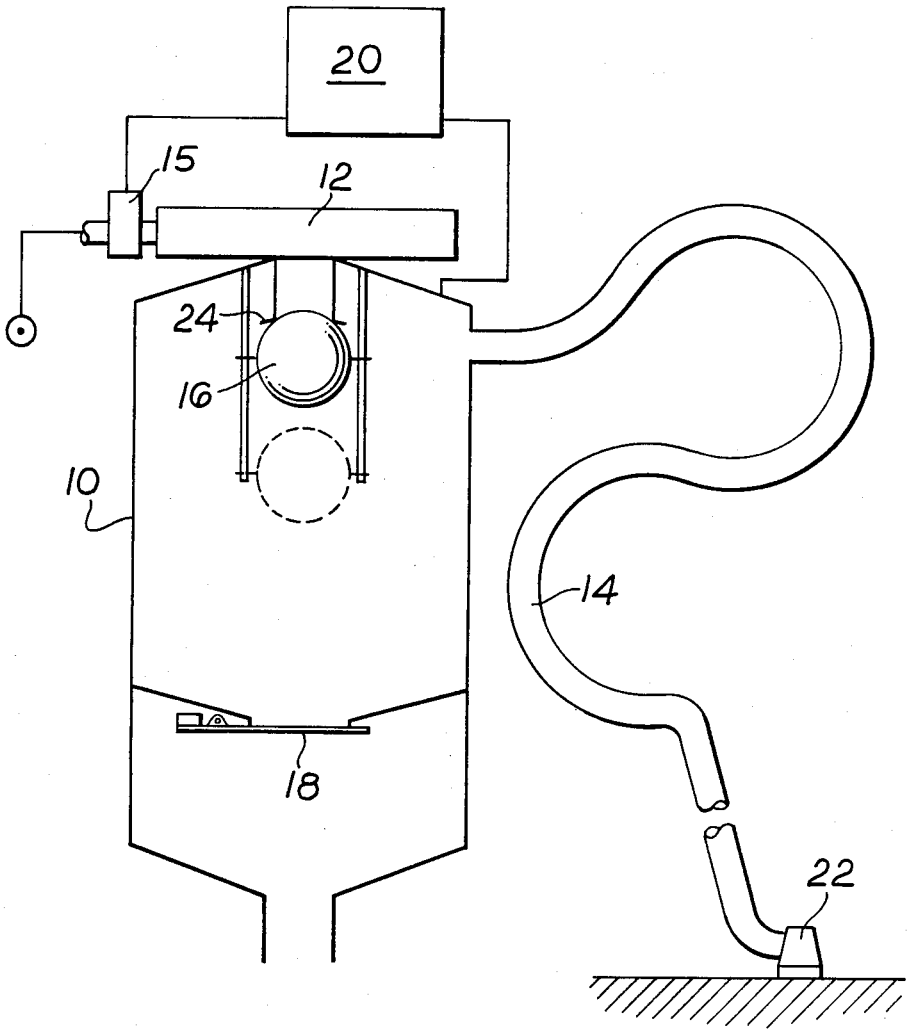
FIG. 1 is a diagrammatic cross-section and block diagram of one apparatus embodying the invention.

With reference to FIG. 1, the present invention provides apparatus for recovering liquids comprising a vessel 10 for containing liquid, a vacuum pump 12 for creating a vacuum in said vessel 10 and a flexible suction hose 14 for sucking liquid into the vessel 10. A ball float valve 16 is adapted to cause a loss of vacuum in the vessel 10 when the liquid reaches a predetermined level and a flap valve 18, adapted to discharge liquid when vacuum is lost, is positioned at the base of the vessel 10. A pneumatic logic system 20 is provided for switching off the air supply to the vacuum pump 12 when vacuum is lost and delaying the start-up of the vacuum pump 12 for a preset period.

An internal vacuum is created in the vessel 10 by means of the vacuum pump 12. This vacuum produces suction at the suction head 22 of the flexible suction hose 14 which sucks liquid from the immediate area around it. As the level of liquid being sucked into the vessel 10 rises, the ball float 16 rises with the surface of the liquid. When the ball float raises to a predetermined level, it is pulled against a flange 24 which causes a loss of vacuum in the vessel 10. Pressure inside the vessel equalises with ambient pressure and the weight of the liquid, acting under gravity, pushes open the flap valve 18 at the base of the vessel 10, thereby discharging the liquid. Loss of vacuum in the vessel 10 causes a pressure actuated valve 26 (FIG. 2) to operate. The signal from this valve is used to shut-off the air to the vacuum pump 12 by means of the pneumatic control system 20. This allows the ball float to fall as the liquid discharges itself.

Figure 2:
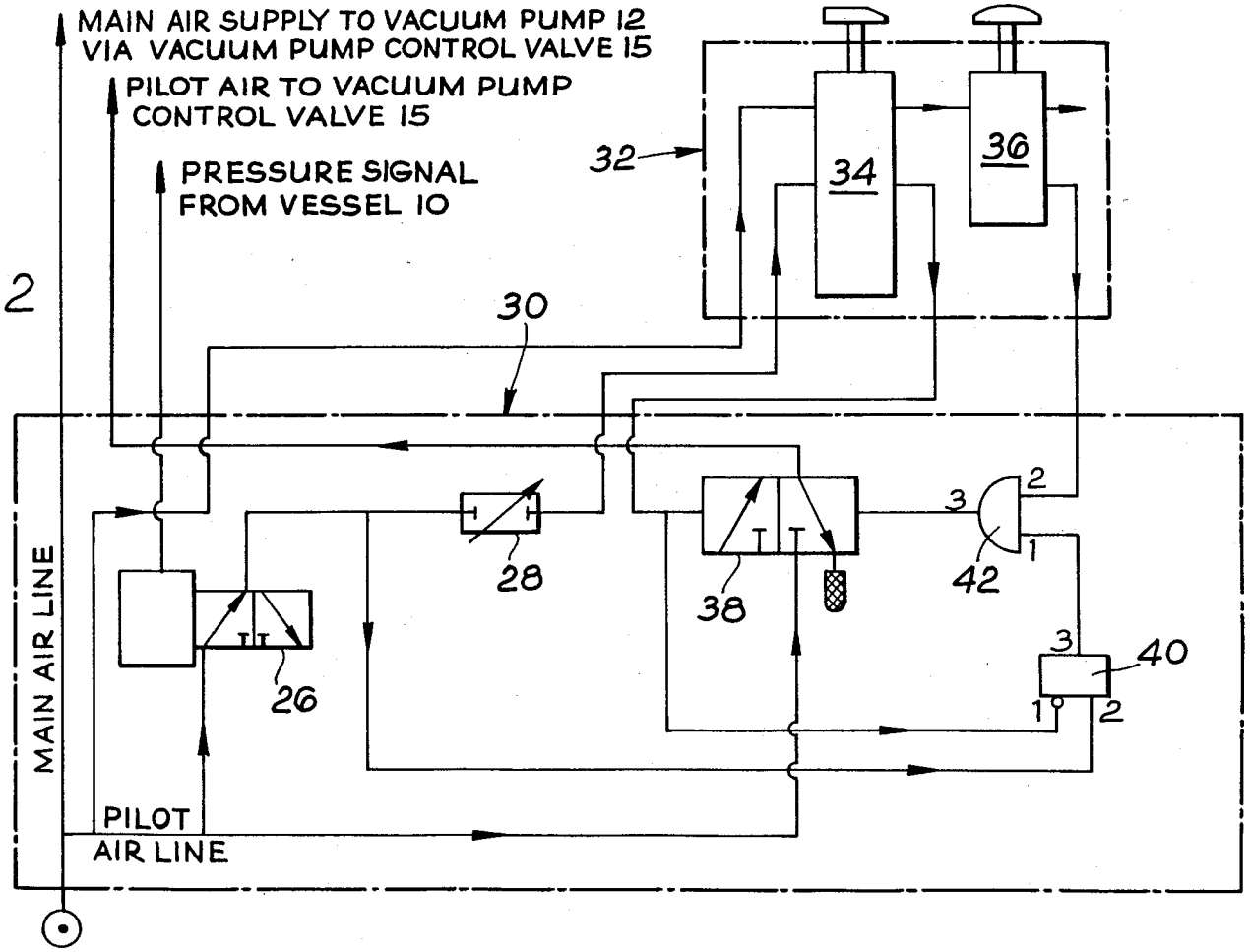
FIG. 2 illustrates the pneumatic control system of FIG. 1 in greater detail.

The pneumatic control system, pertaining to the system shown in FIG. 1, will now be described in more detail with reference to FIG. 2. The pneumatic control system comprises a main logic control panel 30 and a remote control box 32. A pilot air supply, which is tee'd off the main air line, passes through pressure actuated valve 26 when no vacuum is present in the vessel 10. The pilot air then passes through a timer 28 after a delay time has passed. It then passes out of the main logic control panel 30 to the remote control box 32, where it is stopped by a valve 34 which is in the "off" position.

When valve 34 is turned to the "on" position, the pilot air supply will be directed to remote push button 36, main logic valve 38 and port 1 of the 'NOT' unit 40.

The supply to the push button valve 36 is stopped when the valve is in its neutral position (i.e., push button is not depressed).

The pilot air supply to valve 38 causes the valve to change over thus allowing a pilot air supply to a vacuum pump control valve 15. This valve then opens and allows a main air supply on to the vacuum pump 12. When the pump creates vacuum in the vessel 10, the vacuum is sensed by the pressure actuated valve 26 via a signal line from the vessel 10. The pressure actuated valve 26 is set to close when a vacuum greater than 1" mercury, or any other preset vacuum level, is created in the vessel 10. This condition occurs very soon after starting the vacuum pump 12 and the pilot air supply is then stopped at valve 26.

As the vacuum causes liquid to be sucked into the vessel 10 the liquid level rises. The ball float 16 is lifted by the rising liquid level and at a certain level closes on the vacuum tube and therefore creates a loss of vacuum in the vessel. This loss of vacuum causes valve 26 to open which creates an air signal on port 2 of the 'NOT' unit 40, and at the same time an air signal to the timer 28. The air signal to the timer 28 is stopped for a predetermined delay time set by the timer 28.

As the 'NOT' unit 40 is only supplied with one signal, it allows air through. This air signal then passes through an 'OR' unit 42 and onto the right hand side of the valve 38 which closes the air supply to the vacuum pump control valve 15. The pump is therefore switched off which allows the ball float 16 to fall to its low position. The contents of the vessel have meantime discharged via gravity when the vacuum in the vessel was lost due to the ball float 16 closing. When the timer valve 28 has timed out its preset time the air signal then passes therethrough, through valve 34, which is still in the "on"

position, and is then tee'd into port 1 of the 'NOT' unit 40 and into the left hand side of valve 38.

As the 'NOT' unit 40 is now supplied with a positive signal on both ports 1 and 2 there is no output at port 3. Valve 38 therefore moves to the open position via the air signal on the left hand side. This air signal opens the vacuum pump control valve 15 and the main air supply to vacuum pump 12 is created. The pump 12 then creates a vacuum in the vessel 10 and the cycle is then repeated.

If, during a filling cycle of the vessel 10, valve 34 is turned to the "off" position, the system will continue to operate until the ball float valve 16 closes, thus creating a loss of vacuum and thereby stopping the air supply to the pump. When timer 28 has timed out, the air signal to valve 34 will be stopped and therefore only one air signal to the 'NOT' unit 40 will be present and the vacuum pump 12 will remain in the "off" mode.

If it is required to stop the vacuum pump 12 without filling the vessel, it is necessary to turn valve 34 to the "off" position, and, by depressing the push button valve 36 an air signal then passes through valve 36 to the "OR" unit 42. As there is no air signal on the left hand side of valve 38 it will move to the closed position, thereby stopping the air signal to the vacuum pump control valve 15. As valve 34 is in the "off" position the system will remain stopped.

By utilising the above principle, the system can be employed on a continuous basis, with a loss of suction lasting approximately 8 seconds, or any other preset time interval, each time the contents of the vessel are discharged. The contents of the vessel are automatically discharged when the contents reach a predetermined level inside the vessel and suction is automatically reinstated.

The discharge from the vessel could be to a larger tank, container, a drain or a recirculating system.

Figure 3:
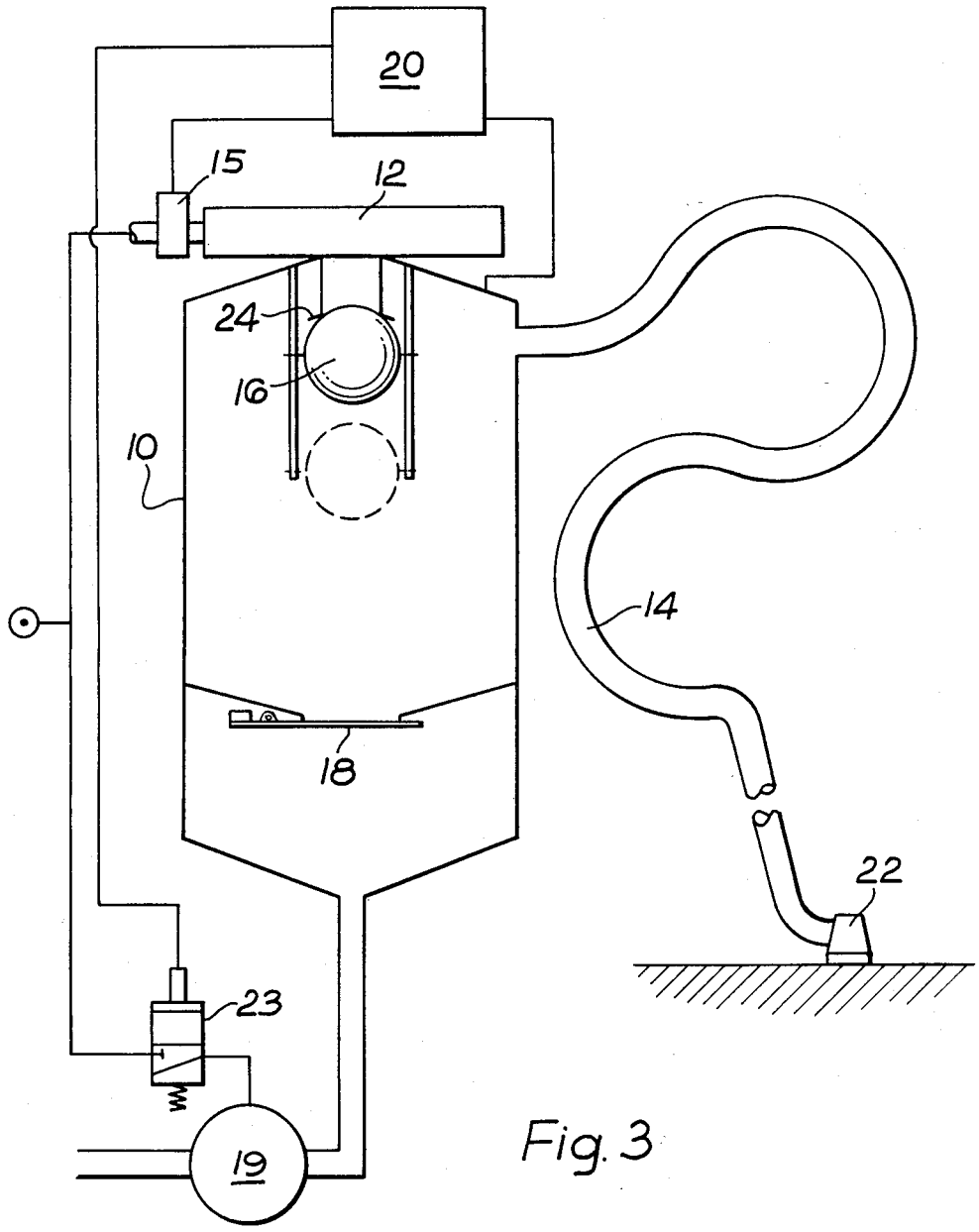
FIGS. 3 and 4 illustrate a second embodiment with views similar to FIGS. 1 and 2, respectively.
Figure 4:
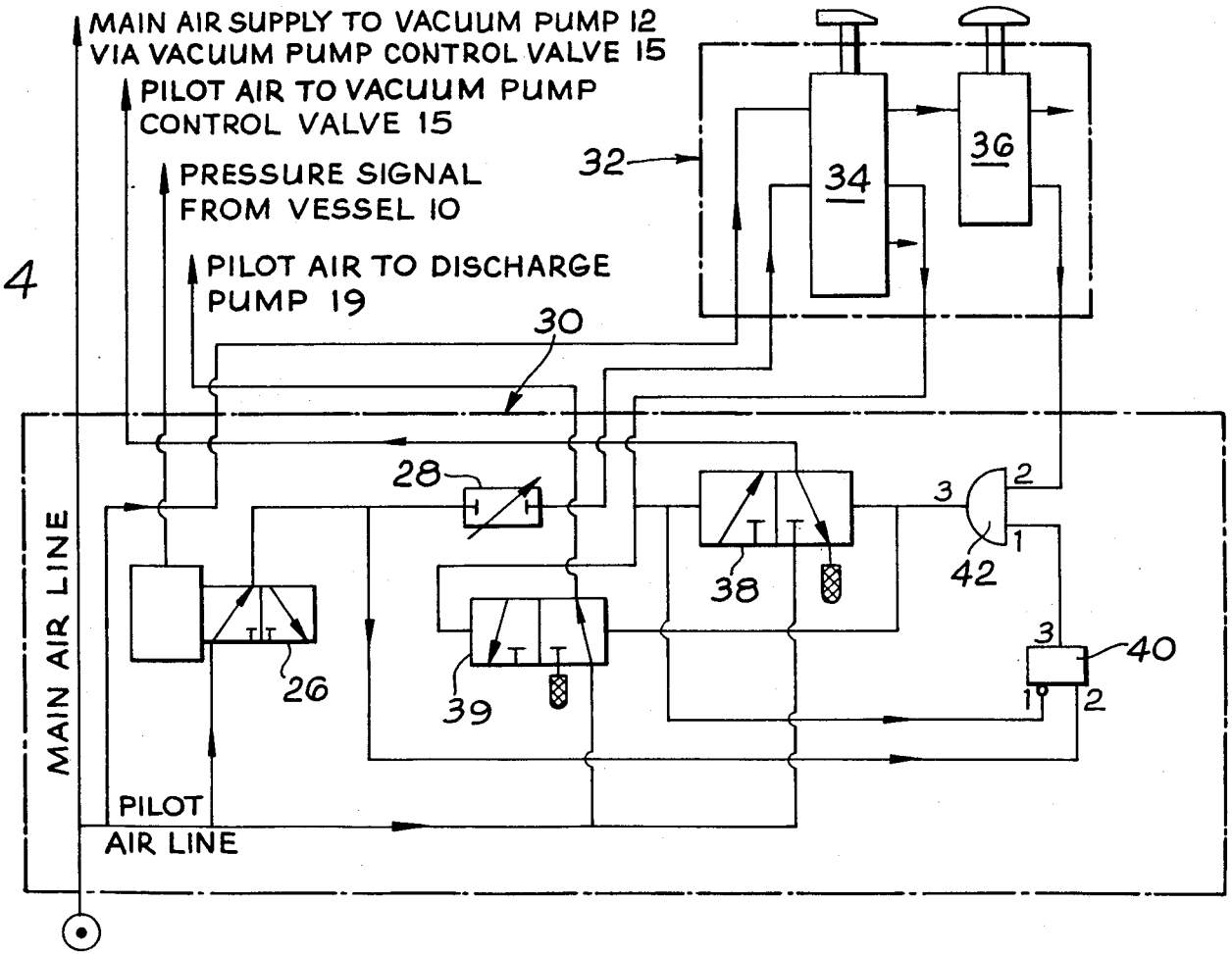

FIGS. 3 and 4 show a modification of the foregoing embodiment, like reference numerals denoting like parts.

In this embodiment, liquid dumped through the flap valve 18 is discharged by means of an air-operated discharge pump 19. Loss of vacuum in the vessel 10 causes the pressure actuated valve 26 to operate as before.

Another branch of the pilot air line passes via the secondary logic valve 39 to a pilot air valve 23 (FIG. 3) in the main air line to the air-operated discharge pump 19.

When main air is turned on, pilot air passes through the secondary logic valve 39 to air valve 23. Air valve 23 opens and the discharge pump 19 begins to pump. As explained above, the other pilot line supply is stopped at valve 34.

When valve 34 is turned to the "on" position, the pilot air supply is directed to remote button 36, main logic valve 38, secondary logic valve 39 and port 1 of the 'NOT' unit 40.

The supply to the push button valve 36 is stopped when the valve is in its neutral position (i.e. push button is not depressed).

The pilot air supply to secondary logic valve 39 causes the valve to change over, thus stopping the pilot air supply to valve 23 (FIG. 3) and thereby stopping the discharge pump 19.

The pilot air supply to valve 38 causes the valve to change over, thus allowing a pilot air supply to the vacuum pump control valve 15. This valve then opens and allows a main air supply onto the vacuum pump 12. When the pump creates a vacuum in the vessel 10, the vacuum is sensed by the pressure actuated valve 26 via a signal line from the vessel 10. The pressure actuated valve 26 is set to close when a vacuum greater than 1" mercury, or any other preset vacuum level, is created in the vessel 10. This condition occurs very soon after starting the vacuum pump 12 and the pilot air supply is then stopped at valve 26.

As the vacuum causes liquid to be sucked into vessel 10 the liquid level rises. The ball float 16 is lifted by the rising liquid level and at a certain level closes on the vacuum tube, and therefore creates a loss of vacuum in the vessel. This loss of vacuum causes valve 26 to open which creates an air signal on port 2 of 'NOT' unit 40, and at the same time an air signal to the timer 28. The air signal to the timer 28 is stopped for a predetermined delay time set by the timer 28.

As the 'NOT' unit 40 is only supplied with one signal, it allows air through. This air signal then passes through an "OR" unit 42 and onto the right hand side of valve 38, which closes the air supply to the vacuum pump control valve 15. This air signal also passes onto the right hand side of valve 39, which opens the pilot air supply to valve 23 (FIG. 3). The result of this is that the vacuum pump 12 is switched off and the discharge pump 19 switched on. As the discharge pump 19 pumps the vessel contents away, the ball float 16 falls. When timer 28 has timed out its preset time the air signal then passes therethrough, through valve 34, which is still in the "on" position, and then into port 1 of the 'NOT' unit 40 and the left hand sides of valves 38 and 39.

As the 'NOT' unit 40 is now supplied with a positive signal on both ports 1 and 2 there is no output at port 3. Valve 39 therefore moves to the closed position, thus stopping the air supply to valve 23, and the discharge pump 19 stops. At the same time valve 38 moves to the open position because of the air signal on the left hand side. This air signal opens the vacuum pump control valve 15 and the main air supply to vacuum pump 12 is created. Pump 12 then creates a vacuum in the vessel 10 and the cycle is then repeated.

If, during a filling cycle of the vessel 10, valve 34 is turned to the "off" position, the system will continue to operate until the ball float valve 16 closes, thus creating a loss of vacuum, and thereby causing the main air supply to switch from the vacuum pump 12 to the discharge pump 19. When timer 28 has timed out, the air signal to valve 34 will be stopped and therefore only one air signal to the 'NOT' unit 40 will be present. Vacuum pump 12 will remain in the "off" mode and discharge pump 19 in the "on" mode.

If it is required to stop vacuum pump 12 without filling the vessel, it is necessary to turn valve 34 to the "off" position, and, by depressing the push button valve 36, an air signal then passes through valve 36 to the "OR" unit 42. As there are no air signals on the left hand sides of valves 38 and 39 they move to the left. This results in the air signal to the vacuum pump control valve 15 being stopped whilst an air signal is now passed via valve 39 to valve 23, which opens and allows main air through to start the discharge pump 19. As valve 34 is in the "off" position, the vacuum pump 12 remains off and discharge pump 19 on. When discharge pump 19 has fully emptied the vessel, then discharge pump 19 can be stopped by shutting off the main air supply to the liquid recovery unit.

In a further modification, it is possible to use a discharge pump without using a flap valve.

The invention thus provides a simple and convenient means of removing drilling mud and like fluids, which will operate automatically with a minimum of operator intervention.

We claim:

1. Apparatus for recovering liquids, comprising a vessel for containing liquid, a vacuum pump for creating a vacuum in said vessel, conduit means for sucking liquid into said vessel, a first valve means actuated by liquid in said vessel on reaching a predetermined level to cause a loss of vacuum in said vessel, means adapted to discharge liquid from the vessel when vacuum is lost, and pneumatic logic means responsive to said loss of vacuum to disable said vacuum pump for a predetermined time period.

2. The apparatus of claim 1, in which said discharge means comprises a flap valve at the bottom of the vessel.

3. The apparatus of claim 1, in which said discharge means comprises a non-return valve.

4. The apparatus of claim 1, in which said discharge means comprises a discharge pump connected to the bottom of the vessel.

5. The apparatus of claim 1, in which said first valve means is a ball float valve.

6. The apparatus of claim 1, in which said conduit means comprises a flexible suction hose provided with a suction head.

7. The apparatus of claim 1, in which said pneumatic logic means comprises a pressure actuated valve responsive to the pressure within said vessel and a pneumatic timer.

* * * * *